United States Patent [19]

Eilers

[11] 4,235,033

[45] Nov. 25, 1980

[54] POLYSTYRENE PADDLE SIGN

[76] Inventor: Steven P. Eilers, 11711 Wayside Ave., Louisville, Ky. 40243

[21] Appl. No.: 4,043

[22] Filed: Jan. 17, 1979

[51] Int. Cl.[3] ..... G09F 21/02

[52] U.S. Cl. ..... 40/586; 40/616

[58] Field of Search ..... 40/586, 616, 545, 596, 40/612; 428/80, 159; 273/DIG. 2

[56] References Cited

U.S. PATENT DOCUMENTS

| | | | |
|---|---|---|---|
| 2,620,289 | 12/1952 | Douglas | 40/616 X |
| 2,716,827 | 9/1955 | Mixter | 40/596 |
| 2,784,510 | 3/1957 | Jaye | 40/615 |
| 2,898,878 | 8/1959 | Reinholdt | 40/586 X |
| 2,996,832 | 8/1961 | Rubin | 273/DIG. 2 |
| 3,096,596 | 7/1963 | Magnuson et al. | 40/616 X |
| 3,117,384 | 1/1964 | Billis | 273/DIG. 2 |
| 3,239,365 | 3/1966 | Petry | 428/159 X |
| 3,440,750 | 4/1969 | Toth et al. | 40/596 X |
| 4,042,919 | 8/1977 | Patty | 40/545 X |

FOREIGN PATENT DOCUMENTS

| | | | |
|---|---|---|---|
| 2032998 | 1/1972 | Fed. Rep. of Germany | 40/612 |
| 83918 | 5/1970 | German Democratic Rep. | 40/584 |
| 922135 | 3/1963 | United Kingdom | 428/159 |

*Primary Examiner*—Robert Peshock
*Assistant Examiner*—G. Lee Skillington
*Attorney, Agent, or Firm*—Charles G. Lamb

[57] ABSTRACT

A portable sign of a lightweight plastic, unitarily constructed, having a raised face with selected portions indented therein to provide a preselected message thereon. For example, when the portable sign is used as a signaling device, the sign is provided with a handle thereon unitary with the sign and the indentations spell out a specific signaling indicia, such as, "STOP" or "SLOW".

5 Claims, 3 Drawing Figures

POLYSTYRENE PADDLE SIGN

BACKGROUND OF THE INVENTION (a) Field of the Invention

This invention relates to portable sign devices and more particularly to a portable sign device which is unitarily constructed of a lightweight plastic.

(b) Description of the Prior Art

Portable signs, particularly for use as traffic signaling devices, are well known. Many of these signs are adapted for being hand-held, and are provided with illuminating or reflecting means. For example, U.S. Pat. Nos. 3,821,860 and 4,042,919 teach hand held paddle signs which are provided with spaced translucent sign panels with illuminating means disposed therebetween. U.S. Pat. No. 3,580,659 teaches a hand held paddle sign including a rotatable mounted reflecting plate. And, U.S. Pat. No. 2,898,878 teaches a luminous reflecting device which is provided with reflector lens and a luminous colored handle wherein the lens and the handle correspond in color. However, in most instances these signs have been relatively expensive, heavy and cumbersome to use. Furthermore, hand held traffic signs of the prior art, in many cases were provided with sharp edges and, by being heavy and cumbersome, presented a safety hazard upon use. The present invention recognizing these past problems, therefore recognizes the need for a portable sign, specifically for traffic signaling, which is light in weight and relatively inexpensive.

SUMMARY OF THE INVENTION

In the present invention, it is recognized that it is desirable to provide a portable sign. It is further recognized that it is desirable to provide a portable sign which is light in weight. Also, it is recognized that it is desirable to provide a portable sign which is relatively inexpensive. Even further, it is recognized that it is desirable to provide a portable sign which may be hand held and is not cumbersome to use. Also, it is desirable to provide a safe to use portable sign.

The present invention advantageously provides a straightforward arrangement of a portable sign which is light in weight, easy to handle, adaptable for hand holding, relatively inexpensive and safe to use.

Various other features of the present invention will become obvious to those skilled in the art upon reading the disclosure set forth hereinafter.

More particularly, the present invention provides a portable sign comprising a unitarily constructed member of lightweight plastic, the member having a raised face with selected portions having indentations therein.

It is to be understood that the description of the examples of the present invention given hereinafter are not by way of limitation. Various modifications within the scope of the present invention will occur to those skilled in the art upon reading the disclosure set forth hereinafter.

BRIEF DESCRIPTION OF THE DRAWING

Referring to the drawings.

DESCRIPTION OF THE PREFERRED EMBODIMENTS OF THE INVENTION

Figure 1:
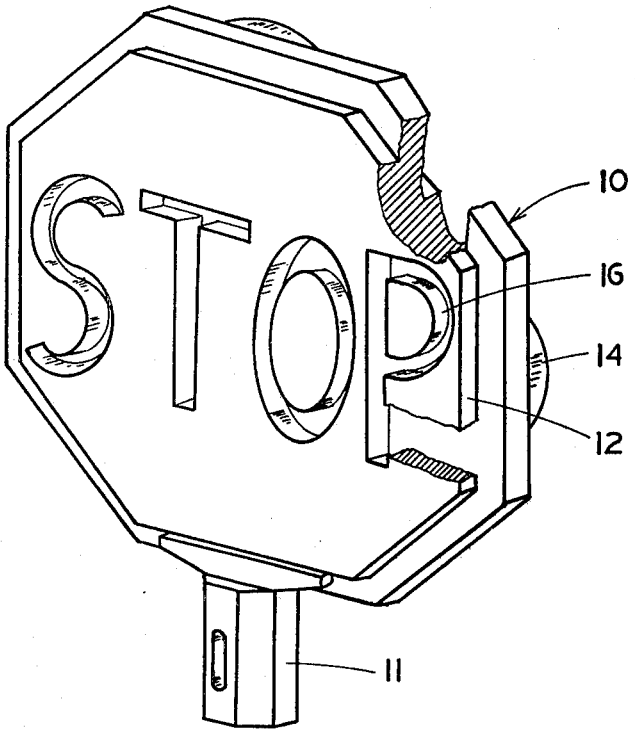
FIG. 1 is a perspective view, with selected portions cut away, of a preferred embodiment of the present invention.
Figure 2:
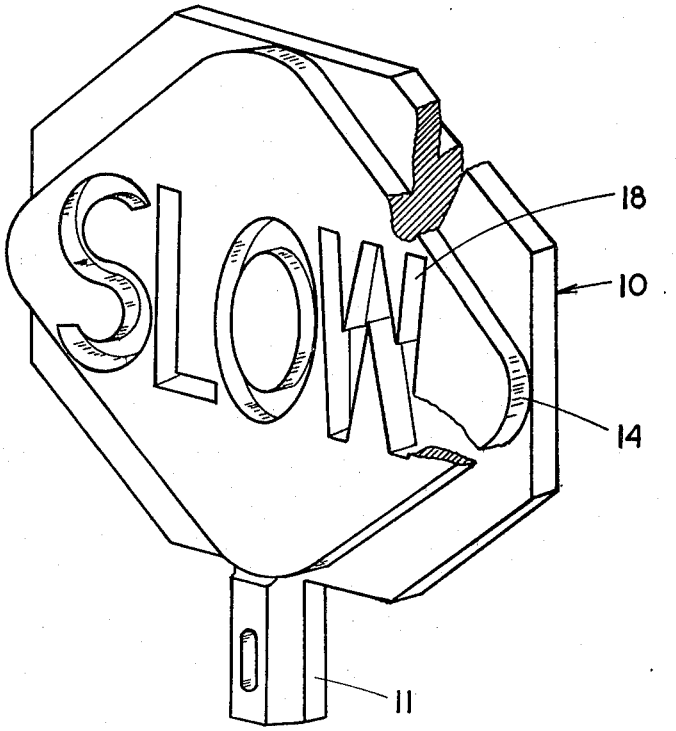
FIG. 2 is a perspective view, with selected portions cut away, of the opposite side of the preferred embodiment of FIG. 1; and, FIG. 3 is a perspective view, with selected portions cut away, of another preferred embodiment of the present invention.

Referring to FIGS. 1 and 2, a portable sign of the present invention comprises a unitarily constructed member 10 of a low density foam plastic having a raised face and back, 12 and 14, respectively. Selected portions of the raised face and back 12 and 14, are indented, as indicated by numerals 16 and 18 respectively, to define specific indicia therein. Generally, the depth of the indentations are substantially equal to the thickness of the raised surfaces 12 and 14. Indented in the face 12, for example, when used as a portable traffic sign, is the word "STOP", as indicated by numeral 16, whereas indented into the raised back 14 is the word "SLOW", as indicated by the numeral 18. The indentations are made during the foaming of the member 10 and will be discussed hereinafter.

On the exemplified traffic sign, a handle 11 is also provided, handle 11 also being unitary with and a part of the member 10. Handle 11 is provided when the portable sign is designed for being hand held, such as in traffic directing.

Figure 3:
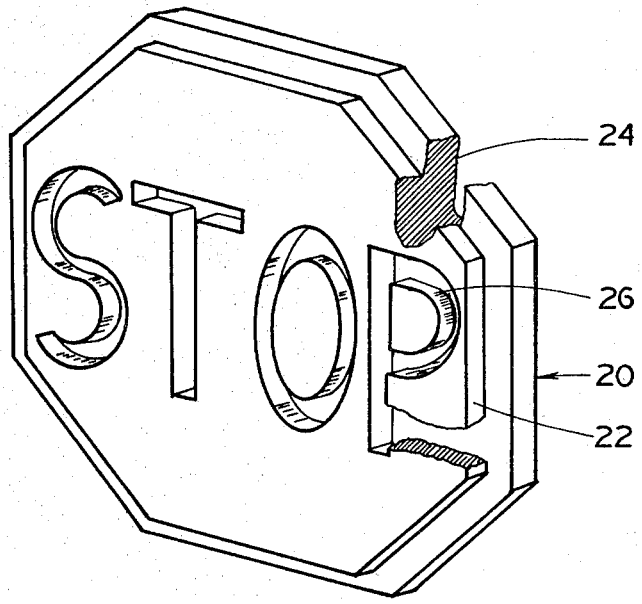

Referring to FIG. 3, a portable sign 20, specifically to be wall mounted, is shown. The sign 20 is a unitarily constructed member of a low density foam plastic having a raised face and a substantially flat back, 22 and 24, respectively. Selected portions of the raised face 22 are indented to define specific indicia thereon, as noted by the numeral 26.

The flat back 24 is generally provided with wall mounting means (not shown) which includes any of those used in the art for hanging wall plaques and the like. This may incude a specific indentation in the back 24 to be received by a nail or the like, or this may include, for example, two-way tape attached to the back.

As has been stated hereinbefore, the unitarily constructed portable sign may be advantageously produced from a light-weight plastic material, the methods for producing the member being well known in the art. A preferred method is to use polystyrene beads which are fed into an appropriate mold designed for the portable sign wherein the beads are then heated to expand in conformity with the mold. However, it is realized that the term "lightweight plastic" or "foam plastic" as used herein includes any method of producing lightweight plastic moldings wherein the density is from 1 to 5 lbs. per cubic foot. In fact, in a traffic sign which is approximately 16 inches wide and 1 to 2 inches in thickness, the weight is generally only a few ounces.

It is realized that by raising the surfaces and preparing the indicia in the foam of indentations, by merely roll painting the surfaces, the indicia is color distinguished and therefore stands out, specifically pointing out the particular message that is indented therein.

It is also realized that various changes may be made to the specific embodiment shown and described without departing from the scope and spirit of the present invention.

What is claimed is:

1. A portable sign consisting of a unitarily constructed member of lightweight plastic having a density of 1 to 5 lbs. per cubic foot, said member having a raised face with selected portions having indentations therein being arranged to provide preselected messages to an observer, said member further including a handle unitary therewith.

2. The portable sign of claim 1, said member having a raised back opposed to said face, said back being provided with selected portions having indentations therein.

3. The portable sign of claim 1, said member being of expanded polystyrene.

4. The portable sign of claim 1, said member having a flat back opposed to said face, said back being provided with means to hang said sign on a wall.

5. The portable sign of claim 1, said indentations being approximately equal to the thickness of the raised face.

* * * * *